US007667590B1

(12) United States Patent
Ryan et al.

(10) Patent No.: US 7,667,590 B1
(45) Date of Patent: Feb. 23, 2010

(54) SYSTEM FOR LOCATING A PLURALITY OF OBJECTS

(76) Inventors: Gary Ryan, 6241 Warner Ave., Huntington Beach, CA (US) 92647; Linda Ryan, 6241 Warner Ave., Huntington Beach, CA (US) 92647

( * ) Notice: Subject to any disclaimer, the term of this patent is extended or adjusted under 35 U.S.C. 154(b) by 319 days.

(21) Appl. No.: 11/474,758

(22) Filed: Jun. 26, 2006

Related U.S. Application Data

(60) Provisional application No. 60/694,129, filed on Jun. 27, 2005.

(51) Int. Cl.
*G08B 1/08* (2006.01)

(52) U.S. Cl. ..... 340/539.1; 340/539.32; 340/539.13; 340/573.1

(58) Field of Classification Search ..... 340/539.1, 340/539.13
See application file for complete search history.

(56) References Cited

U.S. PATENT DOCUMENTS

| | | | | |
|---|---|---|---|---|
| 5,640,146 | A * | 6/1997 | Campana, Jr. | 340/573.4 |
| 5,646,593 | A * | 7/1997 | Hughes et al. | 340/573.1 |
| 5,661,460 | A * | 8/1997 | Sallen et al. | 340/573.4 |
| 5,677,673 | A | 10/1997 | Kipnis | |
| 5,712,628 | A * | 1/1998 | Phillips et al. | 340/10.51 |
| 5,767,784 | A * | 6/1998 | Khamharn | 340/5.23 |
| 5,812,056 | A * | 9/1998 | Law | 340/539.15 |
| 6,133,832 | A | 10/2000 | Winder et al. | |
| 6,317,721 | B1 * | 11/2001 | Hurta et al. | 705/13 |
| 6,535,120 | B1 * | 3/2003 | Sebanc et al. | 340/505 |
| 6,674,364 | B1 | 1/2004 | Holbrook et al. | |
| 6,842,106 | B2 * | 1/2005 | Hughes et al. | 340/5.8 |
| 7,046,153 | B2 * | 5/2006 | Oja et al. | 340/573.4 |
| 7,248,933 | B2 * | 7/2007 | Wildman | 700/90 |
| 7,375,632 | B1 * | 5/2008 | Sebanc | 340/572.1 |
| 7,388,466 | B2 * | 6/2008 | Ghabra et al. | 340/5.61 |
| 7,573,381 | B2 * | 8/2009 | Karr | 340/539.13 |
| 2002/0175820 | A1 * | 11/2002 | Oja et al. | 340/573.4 |
| 2006/0128503 | A1 * | 6/2006 | Savarese et al. | 473/353 |

OTHER PUBLICATIONS

Ook Kim, Chang-Jun Oh, Jong-Kee Kwon, Jong-Ryul Lee, Q-Sang Song, Wonchul Song, Kyung-Soo Kim, and Hyung-Moo Park; A CMOS Implementation of CDMA/FM IF Signal Processor; Semiconductor Div., Electronics and Telecommunications Research Institute; 1997 Symposium on VLSI Circuits Digest of Technical Papers.*

* cited by examiner

*Primary Examiner*—Daniel Wu
*Assistant Examiner*—Brian Wilson

(57) ABSTRACT

An object locating system includes a primary portable controller including controls and LEDs, a transceiver, a digital signal processor, and a memory. The memory includes programmable software instructions that cause the primary controller to emit search signals that have corresponding unique frequencies. A phase-locked loop frequency synthesizer circuit is coupled to the signal processor for comparing a feedback frequency of the search signals. Secondary controllers are removably attached to the objects. Each secondary controller includes a transceiver that has an antenna coupled thereto, a processor, and a memory including software instructions that cause the secondary controller to transmit a location signal upon verifying the identity of the corresponding search signal. The primary and each secondary controller memories are EEPROMs. A transducer is coupled to the processor and emits an audible and visual signal in response to receiving the search signal.

12 Claims, 2 Drawing Sheets

SYSTEM FOR LOCATING A PLURALITY OF OBJECTS

CROSS REFERENCE TO RELATED APPLICATIONS

This application claims the benefit of U.S. Provisional Application No. 60/694,129, filed Jun. 27, 2005.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to object locating systems and, more particularly, to a system for locating a plurality of objects within a target zone.

2. Prior Art

It can be bothersome and time consuming when at home to search for items such as keys, wallets, remote controls etc. that have been mislaid. In addition, at business locations such as offices, warehouses and the like, many valuable employee hours are lost each year searching for mislaid files, equipment, merchandise and the like. As such, a variety of object locating systems have been developed in the prior art.

Unfortunately, with one recent exception, these previous systems are single-use devices where only one object can be located with the system. The one recent exception does allow users to locate up to two objects. Such a system, however, will not allow the user to keep track of more than two items. Also, the system only provides for key chain attachment, and does not allow for a more permanent and secure attachment to a variety of other commonly misplaced items, such as remote-control devices, cell phones, PDA's, pagers, electronic devices, etc. The system also suffers from a multiple system interference problem, described herein below, and does not provide any means to prevent the misplacement of the transmitter itself.

For systems with more than one receiver, no provision is made to easily and conveniently identify which button on the transmitter corresponds to which lost object. This results in the user occasionally pressing the wrong button and locating the wrong object. This is a nuisance and results in lost time and effort in retrieving an object. Furthermore, each receiver requires different circuitry to specifically respond to a selected transmitter signal.

Accordingly, a need remains for a system for locating a plurality of objects in order to overcome the above-noted shortcomings. The present invention satisfies such a need by providing a system that is convenient and easy to use, is versatile in its application, is durable in design, and allows a user to quickly and easily locate a variety of misplaced objects. Such a system allows a person to clearly distinguish between various objects, thus eliminating the chance of inadvertently attempting to locate an object that was not misplaced. The object locating system is also easy to use, thus allowing persons of all ages to effectively locate misplaced items.

BRIEF SUMMARY OF THE INVENTION

In view of the foregoing background, it is therefore an object of the present invention to provide a system for locating a plurality of objects. These and other objects, features, and advantages of the invention are provided by a wireless object locating system for finding a plurality of objects within a target zone.

The wireless object locating system includes a primary portable controller including a plurality of controls and LEDs that are disposed on an outer surface thereof, and a transceiver. A digital signal processor is electrically coupled directly to the transceiver, and a memory is electrically coupled directly to the digital signal processor. Such a memory includes programmable software instructions that cause the primary controller to emit a plurality of search signals that have corresponding unique frequencies respectively. The programmable software instructions of the primary controller memory preferably execute a logic algorithm including the steps of identifying which ones of the controls have been depressed, randomly associating a numerical value with each of the controls, and instructing the frequency synthesizing circuit to sequentially transmit the numerical value to the point-to-multi-point network interface circuit based upon an order in which the controls where activated. Further steps include detecting whether a corresponding one of the location signals has been received by the transceiver of the primary controller, and canceling the numerical value associated with a corresponding one of the secondary controllers associated with the detected location signal.

An analog to digital converter may be electrically coupled directly to the transceiver. Such a converter receives an analog user input from the controls and converts the analog user input to a digital user input prior to reaching the digital signal processor. A frequency synthesizer circuit is electrically coupled directly to the digital signal processor. Such a frequency synthesizer circuit is a phase-locked loop frequency synthesizer for effectively comparing a feedback frequency of the search signals.

The primary controller preferably further includes a mechanism for simultaneously locating all of the plurality of secondary controllers such that the user is advantageously able to simultaneously and independently located each of the objects during a single time period. Such a simultaneous locating mechanism includes a point-to-multipoint network interface circuit electrically coupled directly to the frequency synthesizer circuit such that each of the search signals are sequentially transmitting within the target zone without causing interference between each of the search signals.

A plurality of secondary controllers are directly and removably attached to the plurality of objects respectively. Each of the secondary controllers includes a transceiver that has an antenna electrically coupled thereto, a processor operably coupled to the transceiver, and a memory electrically coupled directly to the processor. Such a memory includes programmable software instructions that effectively cause the secondary controller to transmit a location signal upon verifying the identity of the corresponding search signal. The primary controller memory and each of the secondary controller memories are EEPROMs. A transducer is electrically coupled directly to the processor. Such a transducer emits an audible and visual signal in response to receiving the search signal.

Each of the secondary controllers preferably further includes a tuned frequency circuit electrically coupled directly to the transceiver and the processor. Such a tuned frequency circuit detects and receives one of the search signals when a predetermined frequency is detected within a defined range of the tuned frequency circuit. Each of the secondary controllers may further include a fastener that is directly connected thereto so that a user can conveniently removably affix the secondary controllers to the objects respectively.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
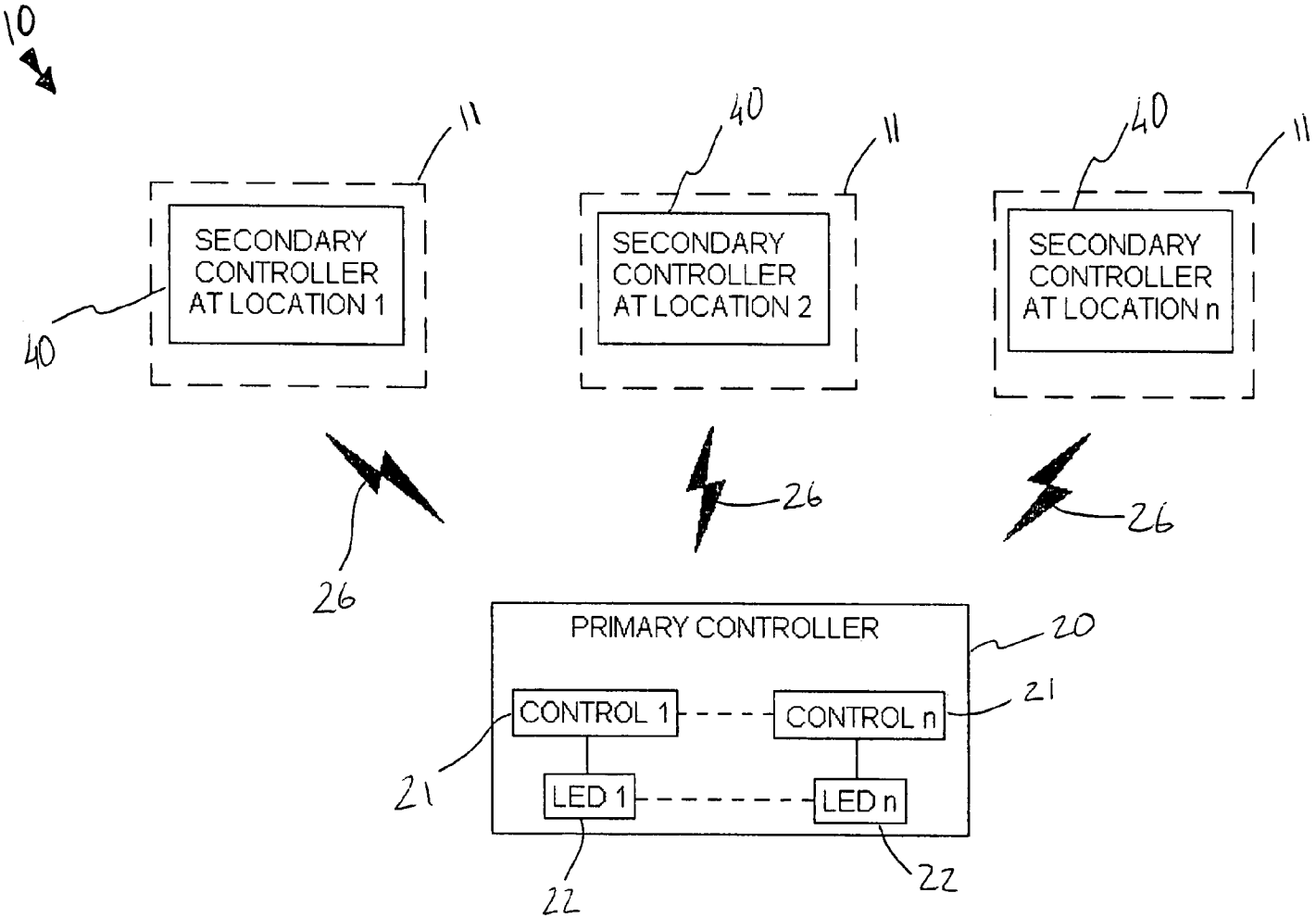
FIG. 1 is a schematic block diagram showing a system for locating a plurality of objects, in accordance with the present invention.
Figure 2:
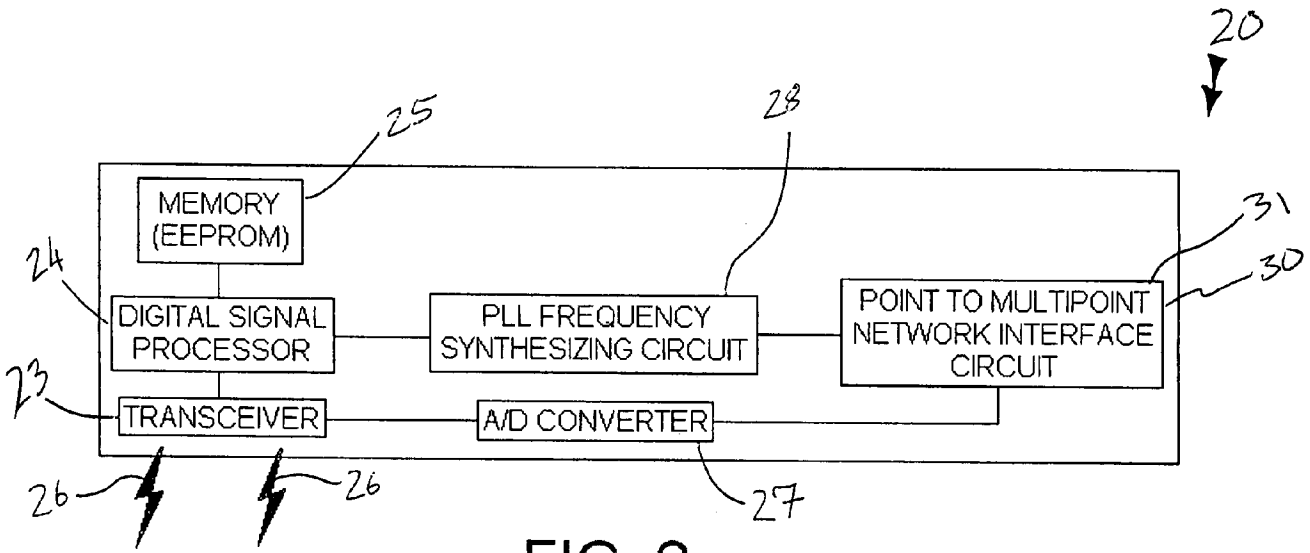
FIG. 2 is a detailed schematic block diagram of the primary controller shown in FIG. 1.
Figure 3:
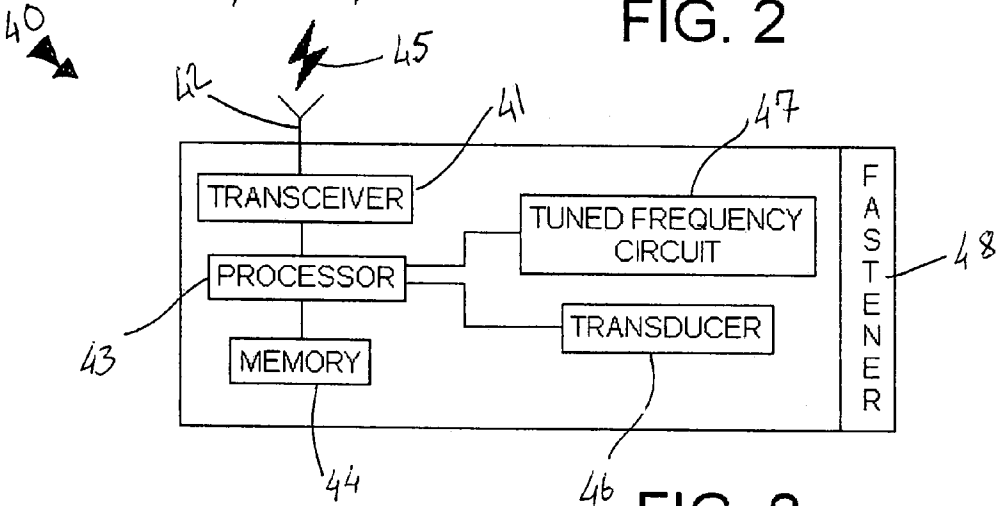
FIG. 3 is a detailed schematic block diagram of the secondary controllers shown in FIG. 1.

The system of this invention is referred to generally in FIGS. 1-3 by the reference numeral 10 and is intended to provide a system for locating a plurality of objects. It should be understood that the system 10 may be used to locate many different types of objects and should not be limited in use to only locating misplaced remote-controls.

Initially referring to FIGS. 1 and 2, the system 10 includes a primary portable controller 20 including a plurality of controls 21 and LEDs 22 that are disposed on an outer surface thereof, and a transceiver 23. A digital signal processor 24 is electrically coupled directly, without the use of intervening elements, to the transceiver 23, and a memory 25 is electrically coupled directly, without the use of intervening elements, to the digital signal processor 24. Such a memory 25 includes programmable software instructions that cause the primary controller 20 to emit a plurality of search signals 26 that have corresponding unique frequencies respectively.

Again referring to FIGS. 1 and 2 The programmable software instructions of the primary controller memory 25 execute a logic algorithm including the steps of identifying which ones of the controls 21 have been depressed, randomly associating a numerical value with each of the controls 21, and instructing the frequency synthesizing circuit 28 (described herein below) to sequentially transmit the numerical value to the point-to-multi-point network interface circuit 31 (described herein below) based upon an order in which the controls 21 where activated. Further steps include detecting whether a corresponding one of the location signals 45 (described herein below) has been received by the transceiver 23 of the primary controller 20, and canceling the numerical value associated with a corresponding one of the secondary controllers 40 (described herein below) associated with the detected location signal 45.

Referring to FIG. 2, an analog to digital converter 27 is electrically coupled directly, without the use of intervening elements, to the transceiver 23. Such a converter 27 receives an analog user input from the controls 21 and converts the analog user input to a digital user input prior to reaching the digital signal processor 24. A frequency synthesizer circuit 28 is electrically coupled directly, without the use of intervening elements, to the digital signal processor 24. Such a frequency synthesizer circuit 28 is a phase-locked loop frequency synthesizer, which is essential for effectively comparing a feedback frequency of the search signals 26.

Still referring to FIG. 2, the primary controller 20 further includes a mechanism 30 for simultaneously locating all of the plurality of secondary controllers 40, which is vital such that the user is advantageously able to simultaneously and independently located each of the objects 11 during a single time period. Such a simultaneous locating mechanism 30 includes a point-to-multipoint network interface circuit 31 electrically coupled directly, without the use of intervening elements, to the frequency synthesizer circuit 28, which is important such that each of the search signals 26 are sequentially transmitting within the target zone without causing interference between each of the search signals 26.

Referring to FIGS. 1 and 3, a plurality of secondary controllers 40 are directly and removably attached, without the use of intervening elements, to the plurality of objects 11 respectively. Each of the secondary controllers 40 includes a transceiver 41 that has an antenna 42 electrically coupled thereto, a processor 43 operably coupled to the transceiver 41, and a memory 44 electrically coupled directly, without the use of intervening elements, to the processor 43. Such a memory 44 includes programmable software instructions that effectively cause the secondary controller 40 to transmit a location signal 45 upon verifying the identity of the corresponding search signal 26. The primary controller memory 25 and each of the secondary controller memories 44 are EEPROMs.

A transducer 46 is electrically coupled directly to the processor 43. Such a transducer 46 is critical for emitting an audible and visual signal in response to receiving the search signal 26. Each of the secondary controllers 40 further includes a tuned frequency circuit 47 electrically coupled directly, without the use of intervening elements, to the transceiver 41 and the processor 43. Such a tuned frequency circuit 47 is vital for detecting and receiving one of the search signals 26 when a predetermined frequency is detected within a defined range of the tuned frequency circuit 47. Each of the secondary controllers 40 further includes a fastener 48 that is directly connected, without the use of intervening elements, thereto so that a user can conveniently removably affix the secondary controllers 40 to the objects 11 respectively.

In use, the system 10 for locating a plurality of objects 11 is simple and straightforward to operate. First, the user places the primary controller 20 in an easily accessible common area of the home, such as the family room. After collecting all the desired objects, the user marks a desired secondary controller 40 and its respective object 11 with a numbered or colored sticker. Next, each secondary controller is directly and removably attached to the object via the fastener 48. Following the included instructions, the user programs each control 21 of the primary controller 20 to correspond to a specific secondary controller 40.

Thus, when an object 11 is misplaced, the user simply depresses a correctly labeled control 21, which causes the transducer 46 to generate an audible and visual signal that are vital for allowing a user to quickly locate the misplaced object 11. The secondary controller 40 that is attached to the object 11 is tuned to a specific frequency generated by the transceiver 23. Upon reception of the search signal 26 the secondary controller generates the location signal 45 that applies voltage to the transducer 46 for effectively activating same. With the ample audible and visual beacon, the misplaced object 11 can quickly and easily be found.

The present invention employs the point-to-multipoint network interface circuit provided by Ericsson, which produces the MINI-LINK BAS point-to-multipoint microwave transmission solution. By employing the MINI-LINK BAS, the present invention is advantageously able to achieve transmission flexibility, lowers operating costs and has a greater scope for service differentiation for mobile and fixed primary controllers. The MINI-LINK BAS supports both Asynchronous Transfer Mode (ATM) and traditional Time-Division Multiplexed (TDM) transmission. By supporting both ATM and TDM configurations in the same equipment, the present invention efficiently handles traffic both in current generation (such as GSM), and third-generation (3G) mobile networks. Of course, a WLAN or Wi-Fi wireless network may be employed wherein the network where data is transferred between the primary and secondary controllers over wireless radio frequencies, as is obvious to a person of ordinary skill in the art. The controllers employ a network interface card (NIC) to communicate with a wireless access point embedded on the point to multi-point network interface circuit.

Furthermore, the memory in the primary controller as well as the memories in each of the secondary controllers preferably includes electrically erasable programmable read-only memory (EEPROM). Advantageously, EEPROM can be erased by exposing it to an electrical charge, which is crucial for allowing a user to reprogram the primary and secondary controllers as they wish, should this be necessary after an initial programming. Like other types of PROM, EEPROM retains its contents when the power to the primary and secondary controllers is turned off. EEPROM is similar to flash memory (sometimes called flash EEPROM).

The frequency synthesizer circuit of the present invention may include phase-locked loop (PLL) frequency synthesizers for advantageously producing frequencies coherent to a reference frequency of the secondary controllers. Such synthesizers use phase-locked loops that are electronic circuits that consist of a phase/frequency detectors (PFD), low pass filters, and voltage-controlled oscillators (VCO). By employing PLL frequency synthesizers, the present invention uses the PFD to compare a feedback frequency of the search signals with a divided-down version of the reference frequency determined by the secondary controllers.

For example, integral PLL frequency synthesizers divide the output frequency by an integer. Fractional PLL frequency synthesizers divide the output frequency by a non-integer. With both types of devices, the PFD's output (current pulses) are filtered and integrated to generate a voltage. In turn, this voltage drives the VCO to increase or decrease the output frequency, moving the PFD's average output towards zero. Sensitivity varies over the full VCO frequency range. Input reference counters are used to reduce the reference input frequency. Feedback counters are used to reduce the output frequency for comparison with the scaled reference frequency. Thus, the present invention is able to effectively overcome prior art shortcomings are inaccurately locating non-interested objects when broad signals are transmitted. With the accurate and specific calculation of frequency ranges, the present invention is able to simultaneously transmit a plurality of search signals without cross-over on frequency ranges.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A wireless object locating system for finding a plurality of objects within a target zone, said wireless object locating system comprising:

a primary portable controller comprising a plurality of controls and LEDs disposed on an outer surface thereof, a transceiver, a digital signal processor electrically coupled directly to said transceiver, a memory electrically coupled directly to said digital signal processor, said memory including programmable software instructions that cause said primary controller to emit a plurality of search signals having corresponding unique frequencies respectively, and a frequency synthesizer circuit electrically coupled directly to said digital signal processor; and a plurality of secondary controllers directly and removably attached to the plurality of objects respectively, each of said secondary controllers comprising a transceiver having an antenna electrically coupled thereto, a processor operably coupled to said transceiver, a memory electrically coupled directly to said processor, said memory including programmable software instructions that cause said secondary controller to transmit a location signal upon verifying the identity of said corresponding search signal, and a transducer electrically coupled directly to said processor, said transducer emitting an audible and visual signal in response to receiving said search signal; wherein said primary controller further comprises means for simultaneously locating all of said plurality of secondary controllers such that the user is able to simultaneously and independently locate each of the objects during a single time period, said simultaneous locating means comprising a point-to-multipoint network interface circuit electrically coupled directly to said frequency synthesizer circuit such that each of said search signals are sequentially transmitting within the target zone without causing interference between each of said search signals; and an analog to digital converter electrically coupled directly to said transceiver, said converter receiving an analog user input from said controls and converting said analog user input to a digital user input prior to reaching said digital signal processor.

2. The system of claim 1, wherein said programmable software instructions of said primary controller memory execute a logic algorithm comprising the steps of:

a. identifying which ones of said controls have been depressed, b. randomly associating a numerical value with each of said controls, c. instructing said frequency synthesizing circuit to sequentially transmit said numerical value to said point-to-multi-point network interface circuit based upon an order in which said controls where activated, d. detecting whether a corresponding one of said location signals has been received by said transceiver of said primary controller, and e. canceling said numerical value associated with a corresponding one of said secondary controllers associated with said detected location signal.

3. The system of claim 1, wherein each of said secondary controllers comprises:

a tuned frequency circuit electrically coupled directly to said transceiver and said processor, said tuned frequency circuit for detecting and receiving one of said search signals when a predetermined frequency is detected within a defined range of said tuned frequency circuit.

4. The system of claim 3, wherein each of said secondary controllers further comprises:

a fastener directly connected thereto so that a user can removably affix said secondary controllers to the objects respectively.

5. A wireless object locating system for finding a plurality of objects within a target zone, said wireless object locating system comprising:

a primary portable controller comprising a plurality of controls and LEDs disposed on an outer surface thereof, a transceiver, a digital signal processor electrically coupled directly to said transceiver, a memory electrically coupled directly to said digital signal processor, said memory including programmable software instructions that cause said primary controller to emit a plurality of search signals having corresponding unique frequencies respectively, and a frequency synthesizer circuit electrically coupled directly to said digital signal processor, wherein said frequency synthesizer circuit is a phase-locked loop frequency synthesizer for comparing a feedback frequency of said search signals; and a plurality of secondary controllers directly and removably attached to the plurality of objects respectively, each of said secondary controllers comprising a transceiver having an antenna electrically coupled thereto, a processor operably coupled to said transceiver, a memory electrically coupled directly to said processor, said memory including programmable software instructions that cause said secondary controller to transmit a location signal upon verifying the identity of said corresponding search signal, and a transducer electrically coupled directly to said processor, said transducer emitting an audible and visual signal in response to receiving said search signal; wherein said primary controller further comprises means for simultaneously locating all of said plurality of secondary controllers such that the user is able to simultaneously and independently locate each of the objects during a single time period, said simultaneous locating means comprising a point-to-multipoint network interface circuit electrically coupled directly to said frequency synthesizer circuit such that each of said search signals are sequentially transmitting within the target zone without causing interference between each of said search signals; and an analog to digital converter electrically coupled directly to said transceiver, said converter receiving an analog user input from said controls and converting said analog user input to a digital user input prior to reaching said digital signal processor.

6. The system of claim 5, wherein said programmable software instructions of said primary controller memory execute a logic algorithm comprising the steps of:

a. identifying which ones of said controls have been depressed, b. randomly associating a numerical value with each of said controls, c. instructing said frequency synthesizing circuit to sequentially transmit said numerical value to said point-to-multi-point network interface circuit based upon an order in which said controls where activated, d. detecting whether a corresponding one of said location signals has been received by said transceiver of said primary controller, and e. cancelling said numerical value associated with a corresponding one of said secondary controllers associated with said detected location signal.

7. The system of claim 5, wherein each of said secondary controllers comprises:

a tuned frequency circuit electrically coupled directly to said transceiver and said processor, said tuned frequency circuit for detecting and receiving one of said search signals when a predetermined frequency is detected within a defined range of said tuned frequency circuit.

8. The system of claim 7, wherein each of said secondary controllers further comprises:

a fastener directly connected thereto so that a user can removably affix said secondary controllers to the objects respectively.

9. A wireless object locating system for finding a plurality of objects within a target zone, said wireless object locating system comprising:

a primary portable controller comprising a plurality of controls and LEDs disposed on an outer surface thereof, a transceiver, a digital signal processor electrically coupled directly to said transceiver, a memory electrically coupled directly to said digital signal processor, said memory including programmable software instructions that cause said primary controller to emit a plurality of search signals having corresponding unique frequencies respectively, and a frequency synthesizer circuit electrically coupled directly to said digital signal processor, wherein said frequency synthesizer circuit is a phase-locked loop frequency synthesizer for comparing a feedback frequency of said search signals; and a plurality of secondary controllers directly and removably attached to the plurality of objects respectively, each of said secondary controllers comprising a transceiver having an antenna electrically coupled thereto, a processor operably coupled to said transceiver, a memory electrically coupled directly to said processor, said memory including programmable software instructions that cause said secondary controller to transmit a location signal upon verifying the identity of said corresponding search signal, wherein said primary controller memory and each of said secondary controller memories are EEPROMs, and a transducer electrically coupled directly to said processor, said transducer emitting an audible and visual signal in response to receiving said search signal; wherein said primary controller further comprises means for simultaneously locating all of said plurality of secondary controllers such that the user is able to simultaneously and independently locate each of the objects during a single time period, said simultaneous locating means comprising a point-to-multipoint network interface circuit electrically coupled directly to said frequency synthesizer circuit such that each of said search signals are sequentially transmitting within the target zone without causing interference between each of said search signals; and an analog to digital converter electrically coupled directly to said transceiver, said converter receiving an analog user input from said controls and converting said analog user input to a digital user input prior to reaching said digital signal processor.

10. The system of claim 9, wherein said programmable software instructions of said primary controller memory execute a logic algorithm comprising the steps of:

a. identifying which ones of said controls have been depressed, b. randomly associating a numerical value with each of said controls, c. instructing said frequency synthesizing circuit to sequentially transmit said numerical value to said point-to-multi-point network interface circuit based upon an order in which said controls where activated, d. detecting whether a corresponding one of said location signals has been received by said transceiver of said primary controller, and e. cancelling said numerical value associated with a corresponding one of said secondary controllers associated with said detected location signal.

11. The system of claim 9, wherein each of said secondary controllers comprises:

a tuned frequency circuit electrically coupled directly to said transceiver and said processor, said tuned frequency circuit for detecting and receiving one of said search signals when a predetermined frequency is detected within a defined range of said tuned frequency circuit.

12. The system of claim 11, wherein each of said secondary controllers further comprises:

a fastener directly connected thereto so that a user can removably affix said secondary controllers to the objects respectively.

* * * * *